US008443711B2

(12) United States Patent
Clark et al.

(10) Patent No.: US 8,443,711 B2
(45) Date of Patent: May 21, 2013

(54) GAS OPERATING SYSTEMS, SUBSYSTEMS, COMPONENTS AND PROCESSES

(75) Inventors: Robert Bernard Iredale Clark, Bodmin (GB); Paul Andrew Leitner-Wise, Alexandria, VA (US)

(73) Assignee: Leitner-Wise Defense, Inc., Bodmin, Cornwall (GB)

( * ) Notice: Subject to any disclaimer, the term of this patent is extended or adjusted under 35 U.S.C. 154(b) by 238 days.

(21) Appl. No.: 12/694,061

(22) Filed: Jan. 26, 2010

(65) Prior Publication Data

US 2011/0179945 A1 Jul. 28, 2011

(51) Int. Cl.
*F41A 5/18* (2006.01)

(52) U.S. Cl.
USPC ..... 89/193; 89/191.01

(58) Field of Classification Search
USPC ..... 89/191.01, 191.02, 193
See application file for complete search history.

(56) References Cited

U.S. PATENT DOCUMENTS

| | | | | |
|---|---|---|---|---|
| 2,138,972 | A | | 12/1938 | Lauf |
| 2,965,994 | A | | 12/1960 | Sullivan |
| 2,983,196 | A | * | 5/1961 | Dixon ..... 89/33.25 |
| 3,075,314 | A | | 1/1963 | Bakker |
| 3,090,150 | A | | 5/1963 | Stoner |
| 3,246,567 | A | | 4/1966 | Miller |
| 3,318,192 | A | | 5/1967 | Miller et al. |
| 3,330,183 | A | | 7/1967 | Loffler |
| 3,333,510 | A | | 8/1967 | Muhlemann |
| 3,359,860 | A | | 12/1967 | Muhlemann |
| 3,380,183 | A | | 4/1968 | Miller et al. |
| 4,026,054 | A | | 5/1977 | Snyder |
| 4,244,273 | A | | 1/1981 | Langendorfer et al. |
| 4,269,109 | A | * | 5/1981 | Stoner ..... 89/198 |
| 4,536,982 | A | | 8/1985 | Bredbury et al. |
| 4,663,875 | A | | 5/1987 | Tatro |
| 4,733,489 | A | | 3/1988 | Kurak |
| 4,845,871 | A | | 7/1989 | Swan |
| 5,010,676 | A | | 4/1991 | Kennedy |
| 5,123,194 | A | | 6/1992 | Mason |
| 5,198,600 | A | | 3/1993 | E'Nama |
| 5,247,758 | A | | 9/1993 | Mason |
| 5,343,650 | A | | 9/1994 | Swan |
| 5,590,484 | A | | 1/1997 | Mooney et al. |
| 5,726,377 | A | | 3/1998 | Harris et al. |
| 5,826,363 | A | | 10/1998 | Olson |
| 5,945,626 | A | | 8/1999 | Robbins |
| 6,722,255 | B2 | | 4/2004 | Herring |
| 6,775,942 | B2 | | 8/2004 | Compton |
| 7,213,498 | B1 | | 5/2007 | Davies |
| 7,216,451 | B1 | | 5/2007 | Troy |
| 7,418,898 | B1 | | 9/2008 | Desomma |
| 7,428,795 | B2 | | 9/2008 | Herring |
| 7,461,581 | B2 | | 12/2008 | Leitner-Wise |
| 7,469,624 | B1 | | 12/2008 | Adams |

(Continued)

*Primary Examiner* — Stephen M Johnson

(57) ABSTRACT

A gas operating system for a firearm includes a gas block, a barrel nut that maintains the gas block at a predetermined axial position on a barrel of the firearm, a member that is movable with respect to the gas block axially with respect to the barrel in response to pressure exerted by expanding propellant gases conveyed thereto by the gas block and a mechanical linkage receiving a force form the member urging it in an axial direction of the barrel and coupled with a loading and ejection mechanism of the firearm to convey the force thereto for operating the loading and ejection mechanism. Various embodiments of gas block assemblies and operating rods for gas operating systems for firearms are provided.

2 Claims, 7 Drawing Sheets

U.S. PATENT DOCUMENTS

| | | | |
|---|---|---|---|
| 7,610,844 | B2 | 11/2009 | Kuczynko et al. |
| 7,739,939 | B2 | 6/2010 | Adams |
| 7,775,150 | B2 | 8/2010 | Hochstrate et al. |
| 8,051,595 | B2 | 11/2011 | Hochstrate et al. |
| 8,117,958 | B2 | 2/2012 | Hochstrate et al. |

* cited by examiner

GAS OPERATING SYSTEMS, SUBSYSTEMS, COMPONENTS AND PROCESSES

Gas operating systems for operating loading and ejection mechanisms in firearms are disclosed, as well as subsystems and components thereof, and processes for using the same.

Figure 1A:
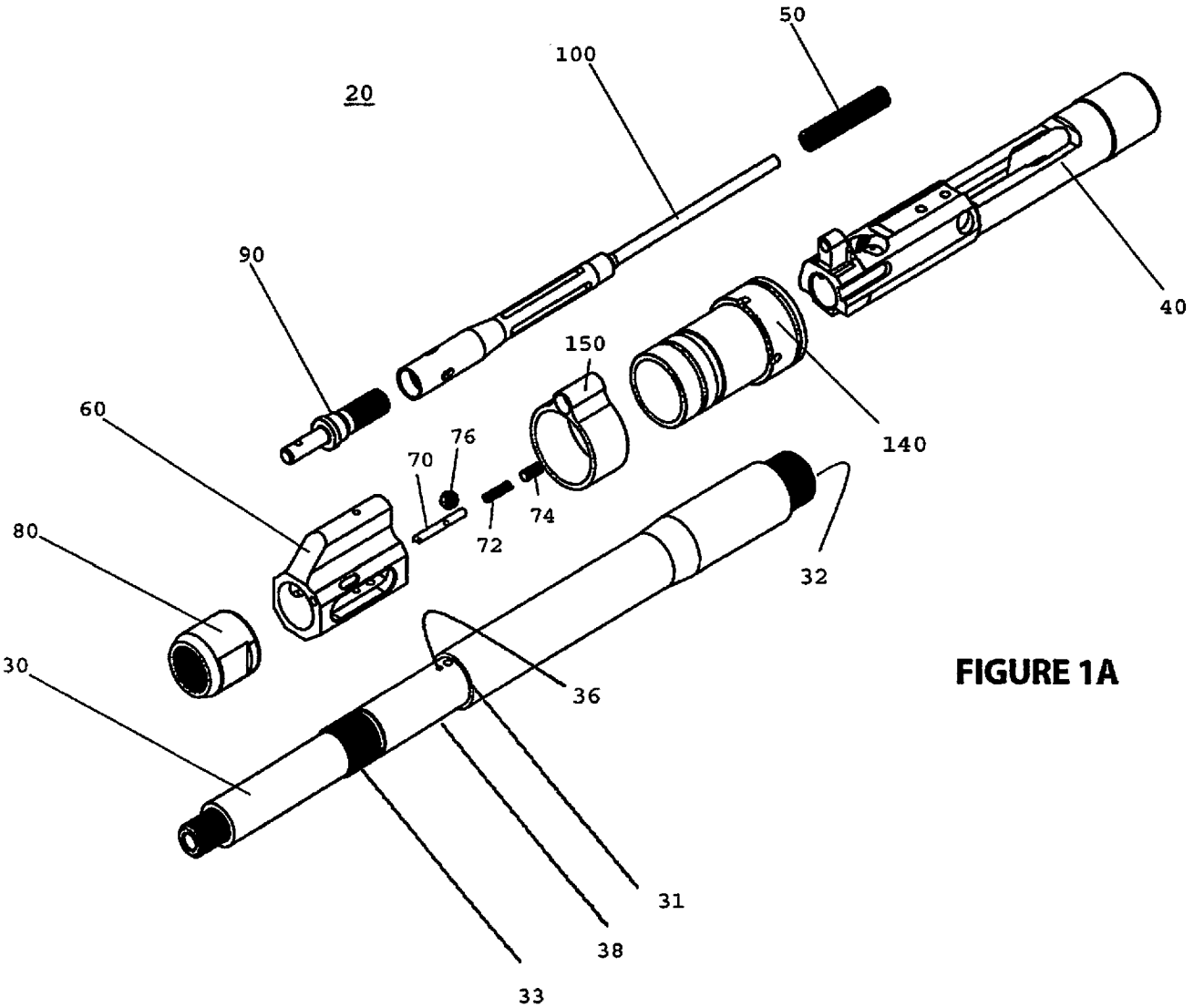
FIG. 1A is an exploded view of a gas operating system for a firearm, along with a barrel of the firearm and a bolt carrier thereof.

A gas operating system for a firearm provides mechanical energy for operating a loading and ejection mechanism of the firearm and comprises a gas block having a surface configured to rest closely against an exterior surface of a barrel of the firearm, the gas block having a fluid pathway therethrough in communication with a port on its surface positioned thereon to mate with a port of the barrel to receive expanding propellant gases therefrom; a barrel nut having a threaded interior facing surface mated with corresponding threads on the exterior surface of the firearm and having a lateral surface abutting a first lateral surface of the gas block to maintain the gas block at a predetermined axial position on the barrel; a member having a surface in fluid communication with the fluid pathway to receive the expanding propellant gases therefrom, the member being movable with respect to the gas block axially with respect to the barrel in response to pressure exerted by the expanding propellant gases; and a mechanical linkage coupled with the member to receive a force therefrom in response to the pressure of the expanding propellant gases, the force urging the mechanical linkage in an axial direction relative to the barrel of the firearm, the mechanical linkage being coupled with the loading and ejection mechanism of the firearm to convey the force thereto for operating the loading and ejection mechanism.

A gas block assembly of a gas operating system for a firearm comprises a gas block having a surface configured to rest closely against an exterior surface of a barrel of the firearm, the gas block having a fluid pathway therethrough in fluid communication with a port on its surface positioned thereon to mate with a port of the barrel to receive expanding propellant gases therefrom; and a barrel nut having a threaded interior facing surface configured to mate with corresponding threads on the exterior surface of the barrel and having a lateral surface configured so that, when the threaded interior surface of the barrel nut mates with the corresponding threads on the exterior surface of the barrel, the lateral surface of the barrel nut abuts a first lateral surface of the gas block to maintain the gas block at a predetermined axial position on the barrel.

A gas operating system for a firearm, the system providing mechanical energy for operating a loading and ejection mechanism of the firearm comprises a gas block having a surface configured to rest closely against an exterior surface of a barrel of the firearm, the gas block having a fluid pathway therethrough in communication with a port on its surface positioned thereon to mate with a port of the barrel to receive expanding propellant gases therefrom; a piston extending axially with respect to the barrel and in fluid communication with the fluid pathway to receive the expanding propellant gases therefrom, the piston having a port for emitting the expanding propellant gases to an exterior thereof; a cylinder having an interior surface circumferentially encompassing the exterior of the piston and movable axially with respect thereto so that the cylinder is urged in an axial direction in response to pressure exerted by the expanding propellant gases emitted by the piston to its exterior; and a mechanical linkage coupled with the cylinder to receive a force therefrom in response to the pressure of the expanding propellant gases, the force urging the mechanical linkage in an axial direction relative to the barrel of the firearm, the mechanical linkage being coupled with the loading and ejection mechanism of the firearm to convey the force thereto for operating the loading and ejection mechanism; the mechanical linkage comprising a distal portion coupled with the cylinder and having a first diameter, and a proximal portion extending from the distal portion and coupled with the loading and ejection mechanism, the proximal portion having a second diameter smaller than the first diameter.

An operating rod of a gas operating system for a firearm, the operating rod serving to convey mechanical force produced by expanding propellant gases to a loading and ejection system of the firearm and comprising a cylinder having an interior surface configured to circumferentially encompass an exterior of a piston operative to expel expanding propellant gases to its exterior, the cylinder being movable axially with respect to a barrel of the firearm in response to pressure exerted by the expanding propellant gases expelled from the piston; an intermediate portion having a first diameter, a distal end coupled with the cylinder and a proximal end; and a rod having a diameter smaller than the first diameter, the rod extending axially with respect to the barrel and having a distal end coupled with the proximal end of the intermediate portion and a proximal end coupled with the loading and ejection mechanism.

A process for disassembling a gas operating system of a firearm comprises moving a barrel nut towards a muzzle end of a barrel of the firearm, the barrel nut having interior facing threads engaged with threads on an exterior surface of a barrel of the firearm to retain a gas block in an operative axial position on the barrel, by rotating the barrel nut to at least partially disengage its threads from those on the barrel; after moving the barrel nut, moving the gas block axially toward the muzzle end of the barrel; and removing components of the gas operating system intermediate the gas block and a loading and ejection system of the firearm.

An operating rod of a gas operating system for a firearm serves to convey mechanical force produced by expanding propellant gases to a loading and ejection system of the firearm. The operating rod comprises a cylinder having an interior surface configured to circumferentially encompass an exterior of a piston operative to expel expanding propellant gases to its exterior, the cylinder being movable axially with respect to a barrel of the firearm in response to pressure exerted by the expanding propellant gases expelled from the piston and having a proximal end; and a member extending axially with respect to the barrel and having a distal end coupled with the proximal end of the cylinder and a proximal end coupled with the loading and ejection mechanism. The cylinder has at least one vent extending radially therethrough at a first longitudinal position thereof for venting propellant gases therefrom and at least one second vent extending radially therethrough at a second longitudinal position thereof different from the first longitudinal position, for venting propellant gases therefrom.

Figure 1B:
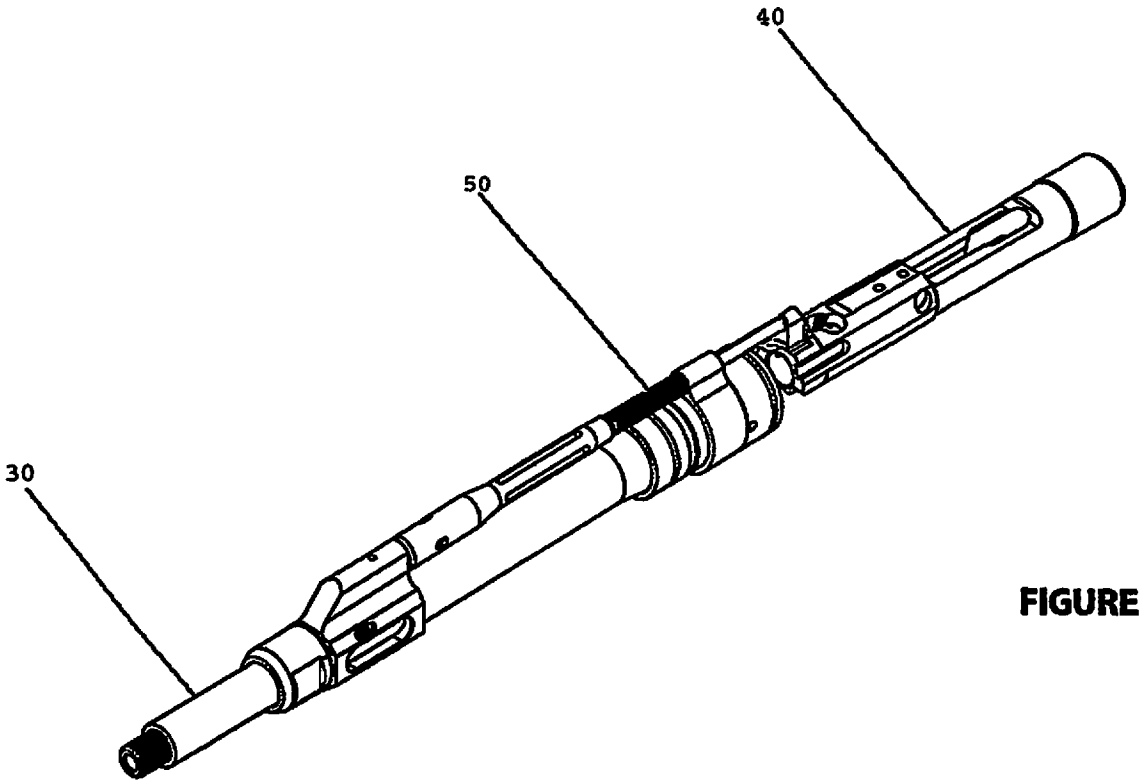
FIG. 1B is a perspective view of the gas operating system of FIG. 1A assembled with the barrel and bolt carrier of the firearm.

In the exploded view of FIG. 1A, a gas operating system 20 of a firearm is illustrated in relation to a barrel 30 of the firearm and a bolt carrier 40 of the firearm. FIG. 1B illustrates the components of FIG. 1A as assembled. In general, the gas operating system employs the pressure of expanding propellant gases obtained from within barrel 30 to supply energy for operating a loading and ejection system of the firearm by means of the bolt carrier 40. More specifically, in this particular embodiment, propellant gases from the barrel 30 are used by the gas operating system 20 to force the bolt carrier 40 in a proximal direction relative to the firearm which causes a shell casing of a spent round to be removed from the breech 32 of the barrel and ejected from the firearm. At the same time, a spring 50 of the gas operating system is compressed and, after the shell casing has been ejected and the pressure of the propellant gases has abated, the energy stored in the spring 50 exerts a force on the bolt carrier 40 causing it to return in a distal direction toward the breech 32 of the barrel 30 thus to chamber a new round for firing.

Figure 2:
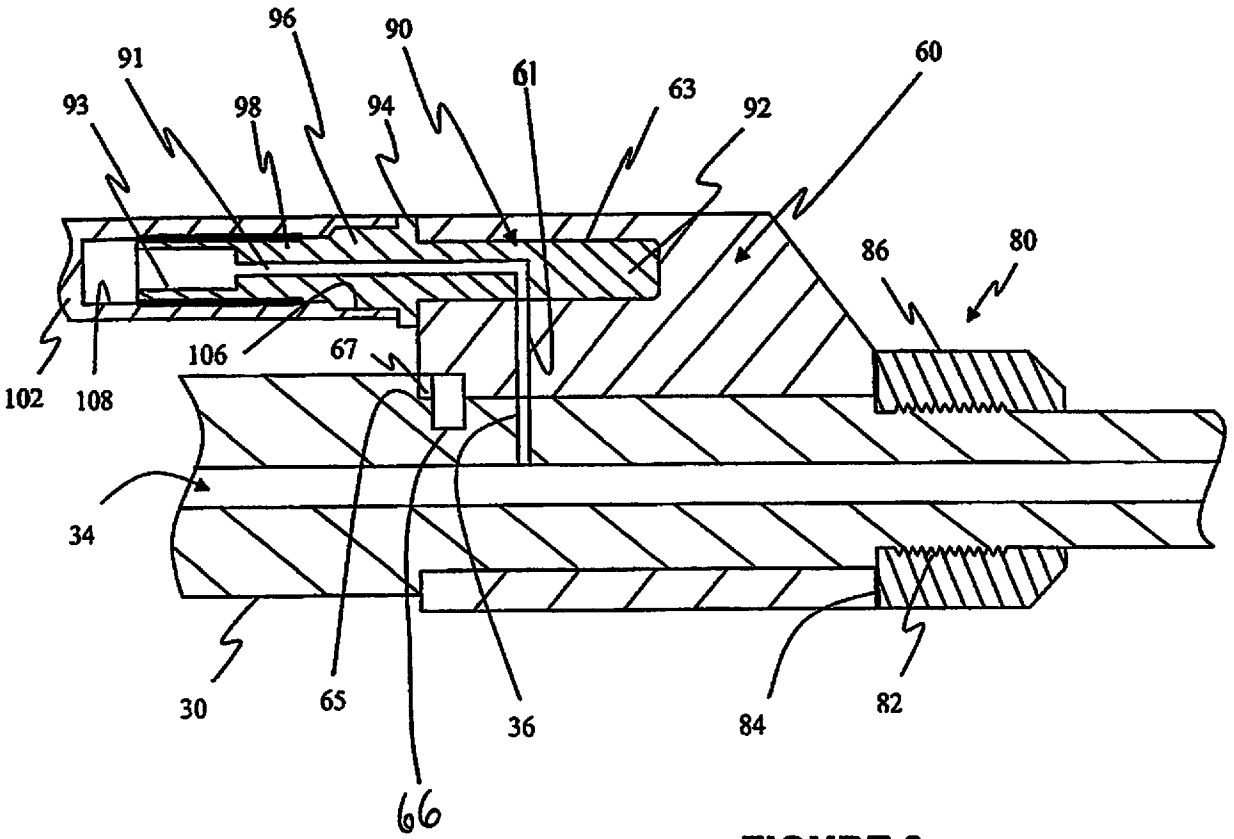
FIG. 2 is a cross-sectional view of a gas block assembly of the gas operating system of FIGS. 1A and 1B.
Figure 3:
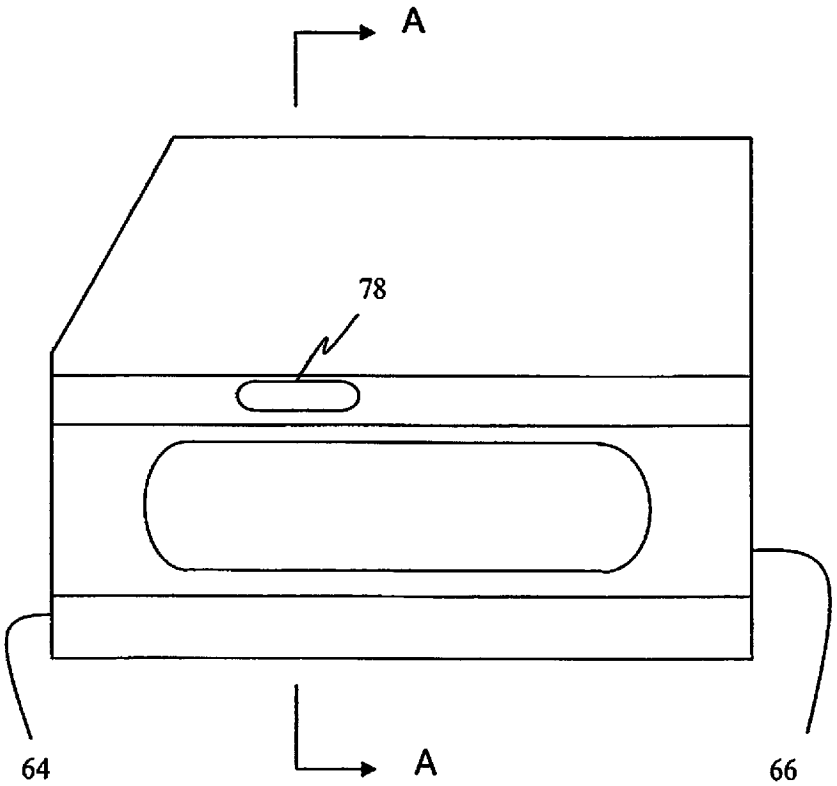
FIG. 3 is a side plan view of a gas block of FIG. 2.
Figure 3A:
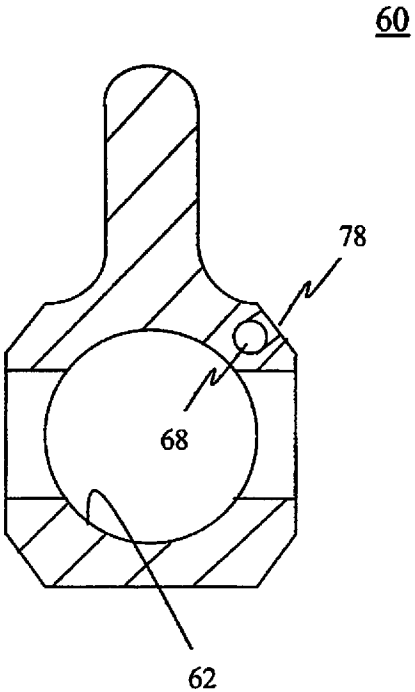
FIG. 3A is a cross-sectional view taken along the lines A-A of FIG. 3.

The expanding propellant gases are obtained by the gas operating system 20 from an interior bore of the barrel 30. With reference also to FIGS. 2, 3 and 3A, when a shot is fired by the firearm, the projectile passes down a bore 34 of the barrel 30 and eventually passes a radial bore 36 extending from bore 34 to an outer surface of the barrel 30. A gas block 60 of the gas operating system 20 has a first cylindrical interior surface 62 extending axially from a distal lateral wall 64 to a proximal lateral wall 66 thereof. The first cylindrical interior surface 62 of gas block 60 is dimensioned to rest closely against and surround an outer surface 38 of barrel 30 of reduced diameter through which radial bore 36 is formed. The proximal lateral wall 66 abuts a shoulder 31 of barrel 30, thus preventing movement of gas block 60 proximally beyond shoulder 31.

A barrel nut 80 of the gas operating system 20 has a threaded inwardly facing surface 82 configured to engage a threaded portion 33 of outer surface 38 of barrel 30, such that a proximal surface 84 of barrel nut 80 eventually abuts distal lateral wall 64 of gas block 60 as barrel nut 80 is rotated to engage its threads with those of threaded portion 33. An outer surface 86 of barrel nut 80 is knurled to facilitate gripping the barrel nut 80 to rotate it. To prevent unintended rotation of barrel nut 80, thus preventing proper operation of the gas operating system 20, gas block 60 is provided with an axially extending opening 68 (FIG. 3A) extending therethrough to receive a nut lock rod 70 (FIG. 1A) biased distally by a spring 72 which, in turn, is retained in the second axial bore 68 by a grub screw 74. Proximal surface 84 of barrel nut 80 has serrations cut therein (indicated by the relatively heavy lines in FIG. 2) and nut lock rod 70 has a cut distal end to engage the serrations in proximal surface 84 to prevent unintended rotation of barrel nut 80. In order to facilitate intentional rotation of barrel nut 80 for disassembling the operating system 20, a nut lock knob 76 is received in a threaded lateral bore of nut lock rod 70 through an axially extending slot 78 cut in gas block 60 (see FIG. 3). The nut lock knob 76 also prevents unintended movement of nut lock rod 70 from axial bore 68.

It will be seen that the foregoing features securely retain the gas block 60 against unintended axial movement distally, so that proximal wall 66 of gas block 60 remains in abutment with shoulder 31 of barrel 30. Effectively, unintended axial movement of gas block 60 relative to barrel 30 is thus prevented.

Gas block 60 is provided with a radial gas bore 61 extending from its first cylindrical interior surface 62 to an axially extending cylindrical cavity 63 having an opening at the proximal surface 66 of gas block 60. Gas bore 61 is positioned to correspond with an axial position of radial bore 36 through barrel 30 when gas block 60 is securely held in place by shoulder 31 of barrel 30 and barrel nut 80. In order to securely position gas bore 61 circumferentially with respect to radial bore 36, a key 65 is received in a slot 66 formed in barrel 30 near shoulder 31. Key 65 fits closely within an axially extending slot 67 formed through the proximal wall 66 of gas block 60, and which is formed as explained hereinbelow. Accordingly, gas bore 61 is maintained in alignment with radial bore 36 so that it reliably receives expanding propellant gases upon each shot by the firearm.

A piston 90 has a cylindrical distal member 92 received in cylindrical cavity 63 of gas block 60. Piston 90 is maintained securely in cylindrical cavity 63 of gas block 60 by a pin (not shown for purposes of simplicity and clarity) extending through gas block 60 and into a bore of distal member 92 of piston 90. A radially extending flange 94 of piston 90 is located at a proximal end of distal member 92 and abuts proximal wall 66 of gas block 60. Piston 90 has a first cylindrical portion 96 having a relatively larger diameter than distal member 92 and extending proximally from flange 94 and a second cylindrical portion 98 extending from a end of first cylindrical portion 96 opposite flange 94 to a proximal wall of piston 90. Second cylindrical portion 98 has a smaller diameter than first cylindrical portion 96.

A gas conduit 91 is formed in piston 90 having a first portion extending radially from an outer surface of distal member 92 where it communicates with gas bore 61 of gas block 60 to a second portion extending axially from the first portion to an interior wall of an enlarged cylindrical bore 93 extending axially through the proximal wall of piston 90. Expanding propellant gases are thus able to pass through bore 36, gas bore 31, and gas conduit 91 to cylindrical bore 93 so that the propellant gases are emitted to an exterior of piston 90.

Figure 4:
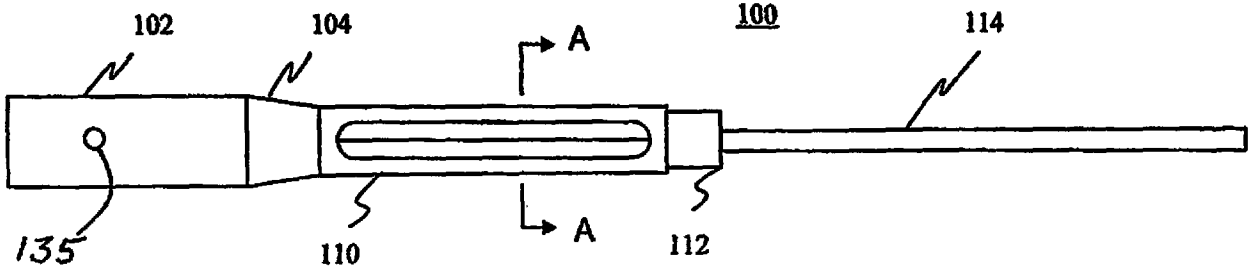
FIG. 4 is a side plan view of an operating rod of the gas operating system of FIGS. 1A and 1B.

With reference also to FIG. 4, an operating rod 100 of the gas operating system 20 has a cylindrical portion 102 extending from a distal end thereof to a frustoconical portion 104 having a diameter tapering from a relatively large diameter of the cylindrical portion to a relatively smaller diameter at a proximal end of the portion 104. Referring again to FIG. 2, it will be seen that cylindrical portion 102 has a first cylindrical bore 106 extending inwardly and axially from a distal end thereof and having a first, relatively large diameter selected to fit closely over an outer surface of first cylindrical portion 96 of piston 90. Extending axially inwardly of cylindrical portion 102 from first cylindrical bore 106 is a second cylindrical bore 108 having a second diameter relatively smaller than the diameter of first cylindrical bore 106 and selected to fit closely over an outer surface of second cylindrical portion 98 of piston 90. The outer surface of second cylindrical portion 98 of piston 90 is provided, at least in part, with circumferentially extending knurls, such as alternating semi-circular depressions interspersed with radially extending ridges, as shown in U.S. Pat. No. 7,461,581, as indicted by the heavy lines on the surface of portion 98 in FIG. 2.

Figure 4B:
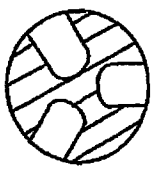
FIG. 4B illustrates an alternate embodiment of the operating rod of FIGS. 4 and 4A.
Figure 4A:
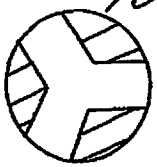
FIG. 4A is a cross-sectional view taken along the lines A-A in FIG. 4.

Operating rod 100 has an intermediate portion 110 extending from an end of portion 104 opposite cylindrical portion 102 proximally to a distal end of a reduced diameter portion 112. Intermediate portion 110 has an outer diameter matching that of the relatively smaller diameter at the proximal end of portion 104. In certain embodiments, as illustrated in FIG. 4A, a plurality of axially extending bores are cut radially into intermediate portion 110 to form it into a plurality of axially extending, spaced-apart struts connecting frustoconical portion 104 with reduced diameter portion 112. In certain embodiments, as illustrated in FIG. 4B, a plurality of axially extending bores are cut radially into intermediate portion 110, but do not form separated struts.

Operating rod 100 has a proximal portion 114 in the form of a rod extending from reduced diameter portion 112 to a proximal end of operating rod 100. Proximal portion 114 has an outer diameter smaller than reduced diameter portion 112 and intermediate portion 110.

The cylindrical portion 102 of operating rod 100 is provided with a plurality of ports 135 extending through its outer surface to the interior of the cylindrical portion 102, for venting propellant gases.

With reference again to FIG. 1A, a barrel nut 140 is fitted over a proximal end of the barrel 30 adjacent its breech 32. The barrel nut 140 is provided with a pin extending radially therefrom (not shown for purposes of simplicity and clarity) which serves to index a top dead center position of the barrel and which is used to align the barrel in an upper receiver of a firearm. The slot 66 as well as the radial bore 36 mentioned hereinabove, are drilled in barrel 30 after the barrel nut 140 has been fitted over the proximal end of barrel 30, to ensure that they will be aligned with the pin extending radially from barrel nut 140. A spring/operating rod guide ring 150 is fitted over and supported by barrel nut 140. Ring 150 has a radially extending portion having an axial aperture therethrough to receive the rod of proximal portion 114 of operating rod 100 to guide the same as it moves reciprocally in an axial direction during firing of the firearm. Spring 50 is fitted over the rod of proximal portion 114. Spring 50 at a distal end thereof abuts the reduced diameter portion 112 of operating rod 100 and at a proximal end of spring 50, it abuts the radially extending portion of ring 150. Proximal portion 114 of operating rod 100 engages a distal end of the bolt carrier 40.

In operation, when a round is fired and the propellant gases drive the bullet past the radial bore 36 in barrel 30, the propellant gases are vented through bore 36, gas bore 31, and gas conduit 91 to cylindrical bore 93 to be emitted to the exterior of piston 90. The pressurized propellant gases drive the operating rod 100 in the proximal direction against the resilient force of spring 50 to force the bolt carrier 40 in the same direction. As is known in the art, the motion of the bolt carrier in the proximal direction releases the bolt, and extracts the shell casing from the breech 32 of the barrel 30, as explained hereinabove. When the operating rod 100 has moved sufficiently in the proximal direction, the vents 135 communicate with the interior of the cylinder 102 to vent the pressurized gases therefrom. This causes the pressure within the cylinder 102 to dissipate, so that the acceleration of the operating rod 100 in the proximal direction declines in a relatively gradual manner. Consequently, the user of the firearm experiences a less impulsive force from the proximal acceleration of the operating rod 100 than would be experience if the pressurized gases were not vented.

In certain advantageous embodiments, multiple vents are provided in the cylindrical portion 102 of operating rod 100 at differing longitudinal positions. In such embodiments the cylindrical portion 102 of operating rod 100 is provided with a plurality of vents positioned at differing longitudinal positions along cylindrical portion 102 and extending through its outer surface to its interior, for venting propellant gases. In certain ones of such embodiments, a first plurality of such vents is arranged at equal angular intervals about the lateral circumference of cylindrical portion 102 and aligned longitudinally thereof. A second plurality of such vents is also arranged at equal angular intervals about the lateral circumference of cylindrical portion 102 and aligned longitudinally thereof, but spaced longitudinally from the first plurality of vents.

Figure 5:
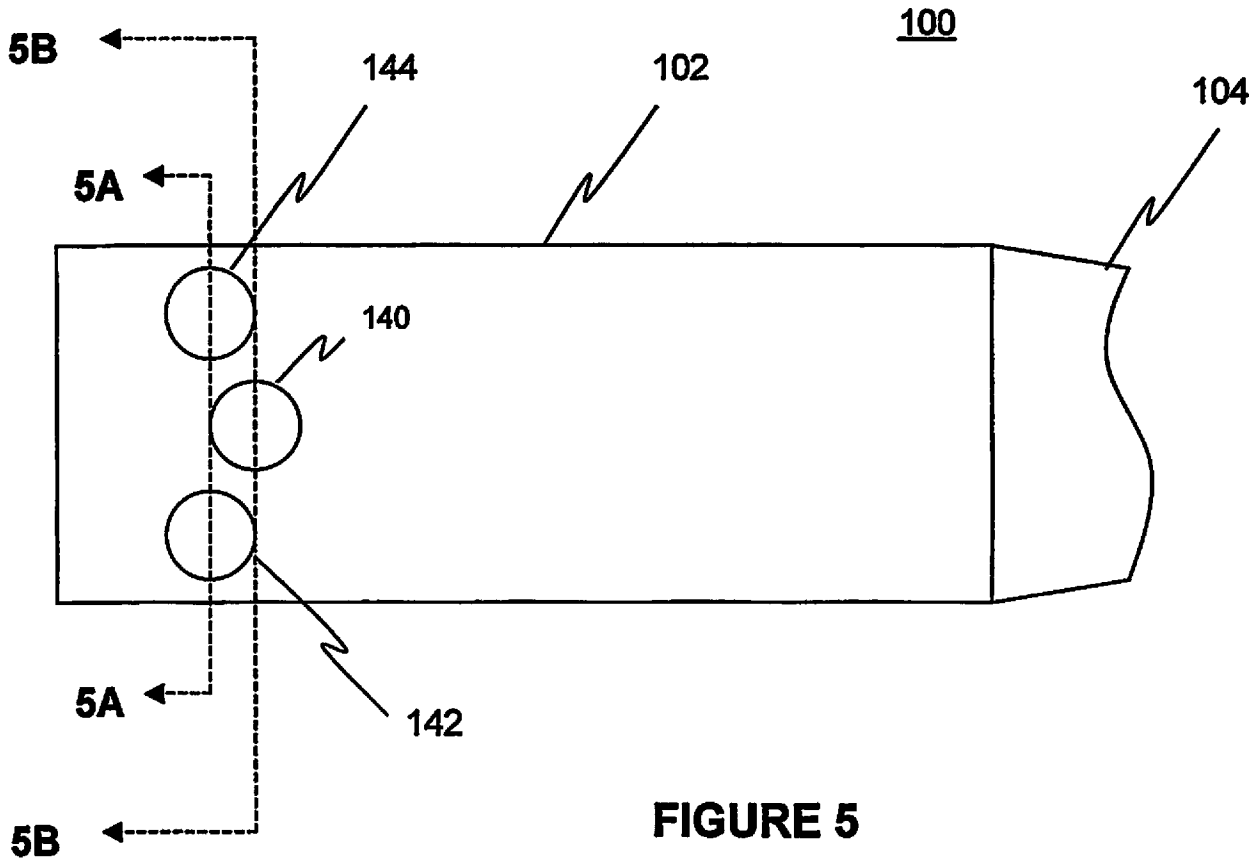
FIG. 5 illustrates a further embodiment of an operating rod of the gas operating system of FIGS. 1A and 1B.
Figure 5B:
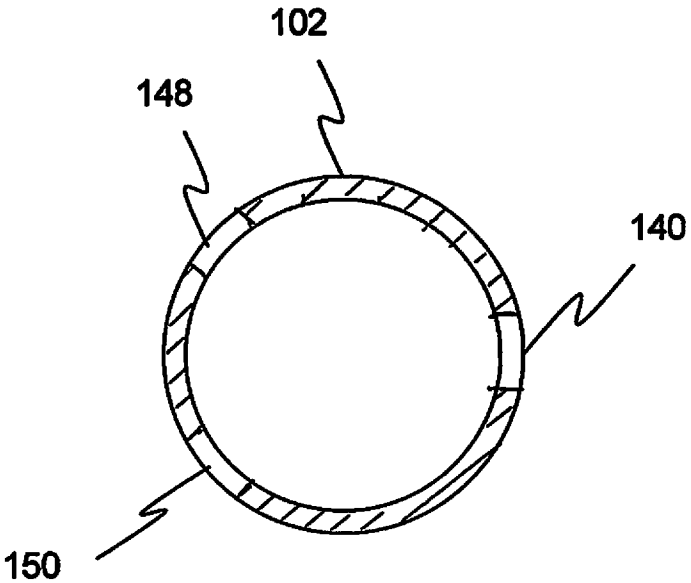
FIG. 5B is a cross sectional view taken along the lines 5B, 5B of FIG. 5.
Figure 5A:
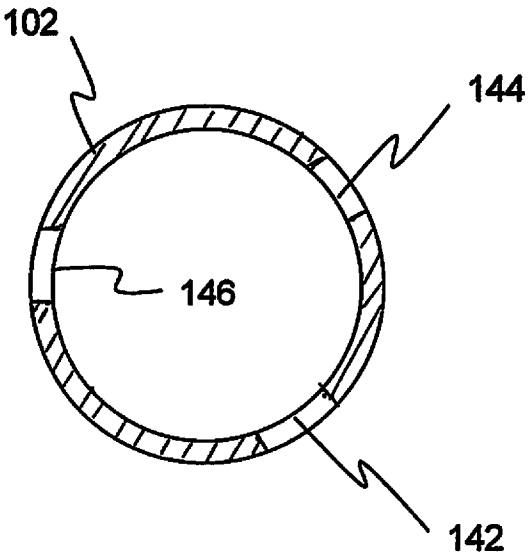
FIG. 5A is a cross sectional view taken along the lines 5A, 5A of FIG. 5.

A particular embodiment of the operating rod 100 is illustrated in FIGS. 5, 5A and 5B, wherein FIG. 5A is a cross section taken along the lines 5A and 5A in FIG. 5 and FIG. 5B is a further cross section taken along the lines 5B and 5B of FIG. 5. With particular reference to FIGS. 5 and 5A, a first plurality of vents 142, 144 and 146 extend radially through cylindrical portion 102 of operating rod 100 and are spaced circumferentially thereabout at equal angular intervals of 120 degrees. Vents 142, 144 and 146 are centered at the same longitudinal position of cylindrical portion 102, and each has the same diameter. With particular reference to FIGS. 5 and 5B, a second plurality of vents 140, 148 and 150 extend radially through cylindrical portion 102 of operating rod 100 spaced circumferentially of cylindrical portion 102 at equal angular intervals of 120 degrees from one to the next, while each thereof is offset by 60 degrees from the positions of adjacent ones of vents 142, 144 and 146. Each of vents 140, 148 and 150 has the same diameter as vents 142, 144 and 146. Vents 140, 148 and 150 are centered at the same longitudinal position of cylindrical portion 102, which, as seen in FIG. 5, is spaced longitudinally from the longitudinal position of the first plurality of vents, 142, 144 and 146, at a distance of one-half of the vent diameter.

By staggering the positions of the vents longitudinally of cylindrical portion 102, it is possible to better accommodate the use of rounds having differing propellant amounts. That is, more vents of a given size (or larger vents) in cylindrical portion 102 are required for venting the gases produced by rounds having relatively large propellant amounts. However, if such vents are all arranged at the same longitudinal position of cylindrical portion 102, rounds having relatively less propellant can be vented too quickly, resulting in short stroking, or the failure to move the bolt carrier sufficiently to eject the spent round and chamber a new round. Since the disclosed vents are longitudinally staggered, they lengthen the venting process, thus extending the ability of rounds having less propellant to drive the operating rod 100. The longitudinally staggered vents as disclosed herein thus provide the ability to accommodate the greater amounts of propellant gases produced by larger rounds, while alleviating the tendency of rounds having relatively less propellant to cause short stroking.

Although various embodiments have been described with reference to a particular arrangement of parts, features and the like, these are not intended to exhaust all possible arrangements or features, and indeed many other embodiments, modifications and variations will be ascertainable to those of skill in the art.

What is claimed is:

1. A gas operating system for a firearm, the system providing mechanical energy for operating a loading and ejection mechanism of the firearm, comprising:

a gas block having a surface configured to rest closely against an exterior surface of a barrel of the firearm, the gas block having a fluid pathway therethrough in communication with a port on its surface positioned thereon to mate with a port of the barrel to receive expanding propellant gases therefrom;

a piston extending axially with respect to the barrel and in fluid communication with the fluid pathway to receive the expanding propellant gases therefrom, the piston having a port for emitting the expanding propellant gases to an exterior thereof;

an operating rod comprising a cylindrical portion having an interior surface circumferentially encompassing the exterior of the piston and movable axially with respect thereto, so that the operating rod is urged in an axial direction in response to pressure exerted by the expanding propellant gases emitted by the piston to its exterior within the cylindrical portion;

the operating rod further comprising an elongated portion extending from to the cylindrical portion in an axial direction relative to the barrel of the firearm, to the loading and ejection mechanism of the firearm to convey a force thereto for operating the loading and ejection mechanism;

the elongated portion comprising a distal portion extending from and exterior to the cylindrical portion and having a first diameter, and a proximal portion extending from the distal portion and coupled with the loading and ejection mechanism, the proximal portion having a second diameter smaller than the first diameter;

wherein the distal portion of the elongated portion comprises a plurality of axially extending struts each having a distal end coupled with the cylinder and a proximal end, the struts being spaced radially from one another; and the proximal portion of the elongated portion comprises a rod extending axially with respect to the barrel and having a distal end coupled with the proximal end of each of the struts and a proximal end coupled with the loading and ejection mechanism.

2. A gas operating system for a firearm, the system providing mechanical energy for operating a loading and ejection mechanism of the firearm, comprising:

a gas block having a surface configured to rest closely against an exterior surface of a barrel of the firearm, the gas block having a fluid pathway therethrough in communication with a port on its surface positioned thereon to mate with a port of the barrel to receive expanding propellant gases therefrom;

a piston extending axially with respect to the barrel and in fluid communication with the fluid pathway to receive the expanding propellant gases therefrom, the piston having a port for emitting the expanding propellant gases to an exterior thereof;

an operating rod comprising a cylindrical portion having an interior surface circumferentially encompassing the exterior of the piston and movable axially with respect thereto so that the operating rod is urged in an axial direction in response to pressure exerted by the expanding propellant gases emitted by the piston to its exterior within the cylinder;

the operating rod further comprising an elongated portion extending from the cylindrical portion in an axial direction relative to the barrel of the firearm, to the loading and ejection mechanism of the firearm to convey a force thereto for operating the loading and ejection mechanism;

the elongated portion comprising a distal portion extending from and exterior to the cylindrical portion and having a first diameter, and a proximal portion extending from the distal portion and coupled with the loading and eiection mechanism, the proximal portion having a second diameter smaller than the first diameter;

wherein the distal portion of the elongated portion has a plurality of axially extending grooves cut therein.

* * * * *